US006937197B2

(12) United States Patent
Wiedmann et al.

(10) Patent No.: US 6,937,197 B2
(45) Date of Patent: Aug. 30, 2005

(54) ANTENNA FOR A CENTRAL LOCKING SYSTEM OF AN AUTOMOTIVE VEHICLE

(75) Inventors: Michael Wiedmann, Hülben (DE); Markus Pfletschinger, Eningen (DE); Dirk Wendt, Dettingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 32 days.

(21) Appl. No.: 10/776,919

(22) Filed: Feb. 10, 2004

(65) Prior Publication Data

US 2004/0174312 A1 Sep. 9, 2004

(30) Foreign Application Priority Data

Feb. 12, 2003 (DE) ..... 103 05 722

(51) Int. Cl.[7] ..... H01Q 1/32
(52) U.S. Cl. ..... 343/713; 343/711
(58) Field of Search ..... 343/704, 711, 343/712, 713

(56) References Cited

U.S. PATENT DOCUMENTS 4,868,577 A * 9/1989 Wingard ..... 343/713
5,646,637 A * 7/1997 Miller ..... 343/713
5,706,015 A * 1/1998 Chen et al. ..... 343/700 MS
5,959,585 A 9/1999 Militz ..... 343/713
6,023,245 A * 2/2000 Gomez et al. ..... 343/725
6,078,293 A * 6/2000 Yamamoto ..... 343/713
6,118,410 A * 9/2000 Nagy ..... 343/713
6,288,684 B1 9/2001 Wiggenhorn et al. ..... 343/713
6,339,403 B1 1/2002 Desai ..... 343/713
6,433,749 B1 * 8/2002 Thompson ..... 343/713

FOREIGN PATENT DOCUMENTS

| | | |
|---|---|---|
| CA | 2 305 860 | 10/2001 |
| DE | 93 14 147 | 2/1994 |
| DE | 295 00 961 | 7/1995 |
| DE | 295 00 961.6 | 7/1995 |
| EP | 0 429 203 | 5/1991 |
| EP | 0 590 955 | 4/1994 |

* cited by examiner

*Primary Examiner*—Tho Phan
(74) *Attorney, Agent, or Firm*—Herbert Dubno

(57) ABSTRACT

An antenna for a keyless entry radiofrequency system of a vehicle has an antenna cable, a conductor of which extends through an opening in the vehicle body with a free end outside said vehicle to prevent shielding of the free end by the vehicle body.

8 Claims, 2 Drawing Sheets

ANTENNA FOR A CENTRAL LOCKING SYSTEM OF AN AUTOMOTIVE VEHICLE

FIELD OF THE INVENTION

Our present invention relates to an antenna for a motor vehicle and particularly to a motor vehicle having a central locking system and especially a central locking system which can be actuated at least in part by a radiofrequency signal transmitted from the exterior of the vehicle.

BACKGROUND OF THE INVENTION

DE 295 00 961 describes a vehicle antenna arrangement in which the antenna serves several functions including radio reception, mobile communications and the like. In such an antenna arrangement, means can be provided for the transmission and reception of radio frequency signals within an antenna housing or apart from the antenna housing, especially when the antenna is of the radio type. The housing can be affixed by an appropriate base to the roof of the vehicle and the roof of the vehicle can have an opening through which the electrical conductors servicing the antenna can extend. Below the housing, the electronic circuitry of the antenna can be provided, this circuitry serving to process the signals to and from the antenna.

Vehicles can also be provided with so-called keyless entry systems, generally in the form of a radio controlled central locking arrangement. That document, however, does not describe such a keyless entry system or any means which can facilitate the actuation of a keyless entry system by a radio-frequency signal from the exterior.

In practice, the transmission of a radiofrequency signal from, for example, a keyless entry transmitter external of the vehicle to a pickup within the interior of the vehicle has involved problems resulting from a shielding of the pickup within the vehicle interior caused by the body of the vehicle.

The pickup for such a keyless entry system has been a piece of coaxial cable which had a conductor extending from that cable with its free end located within the body of the vehicle and thereby shielding via the metallic part of the vehicle body. Sometimes that free conductor was located within a windshield or rear window of the vehicle and then shielding from a vapor-deposited metallic coating on the window could create problems.

As an alternative to cables of this type, functioning as antennae in the interior of the vehicle, were so-called window antennae, in which conductors in or on the window could receive signals for operating the keyless entry system. Such window antennae, however, were not available for some types of vehicles, for example convertibles, and were expensive for others.

Mention should be made as well of German utility model G 93 14 147.5 of Jan. 1994 which describes a vehicle antenna mounted on a vehicle body and serviced by a coaxial cable and to U.S. Pat. No. 6,339,403 which does have a remote keyless entry arrangement.

OBJECTS OF THE INVENTION

It is the principal object of the present invention to provide an antenna for a motor vehicle which is particularly suitable for use with keyless entry systems and is of simple and inexpensive construction.

Another object of the invention is to provide an automotive vehicle which is free from the drawbacks outlined previously.

SUMMARY OF THE INVENTION

These objects and others which will become apparent hereinafter are attained, in accordance with the invention in an antenna for a motor vehicle for the transmission or reception of signals with receiving circuitry for the vehicle and wherein the receiving circuitry is comprised of an antenna structure or antenna cable which has at least one conductor passing through an opening in the body of the vehicle and a free end which is located externally for receiving and transmitting signals from and to the exterior of the vehicle. More particularly, an automotive vehicle according to the invention can comprise:

a vehicle body;

a central locking system in the vehicle body and comprising a radiofrequency receiver and locks operated by the receiver;

an antenna connected to the receiver for receiving radiofrequency signals transmitted to the vehicle body and transmitting radiofrequency signals from the vehicle body, the body having an opening between an interior and an exterior thereof and the antenna having an antenna cable provided with a conductor extending through the opening and having a free end terminating at the exterior of the opening; and a device actuatable from the exterior of the body for producing a radiofrequency signal for pick up by the conductor.

The antenna can be disposed on the surface of the body of the vehicle provided with the opening and can fulfill a multiplicity of radio functions, including normal AM or FM radio functions and mobile radio communications and can include at least one feeder to the antenna system. The feeder or another antenna cable can have the conductor extending through the opening and having its free end terminating at the exterior of that opening to form the receiver for the keyless entry system or central locking system of the vehicle.

The antenna housing or a printed circuit board thereof can have an electrically conducting surface which is connected with the antenna cable. At least one feeder, in accordance with the antenna cable, can be connected by a plug connection and, if desired, further lines or conductors with the transmitting or receiving device. The antenna cable may also be formed as the current supply unit for the circuitry of the antenna and the coupling to the antenna cable can be effected compositively. The signal coupling, in particular, may be effected via a coupling condenser which is integrated in the plug connection.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
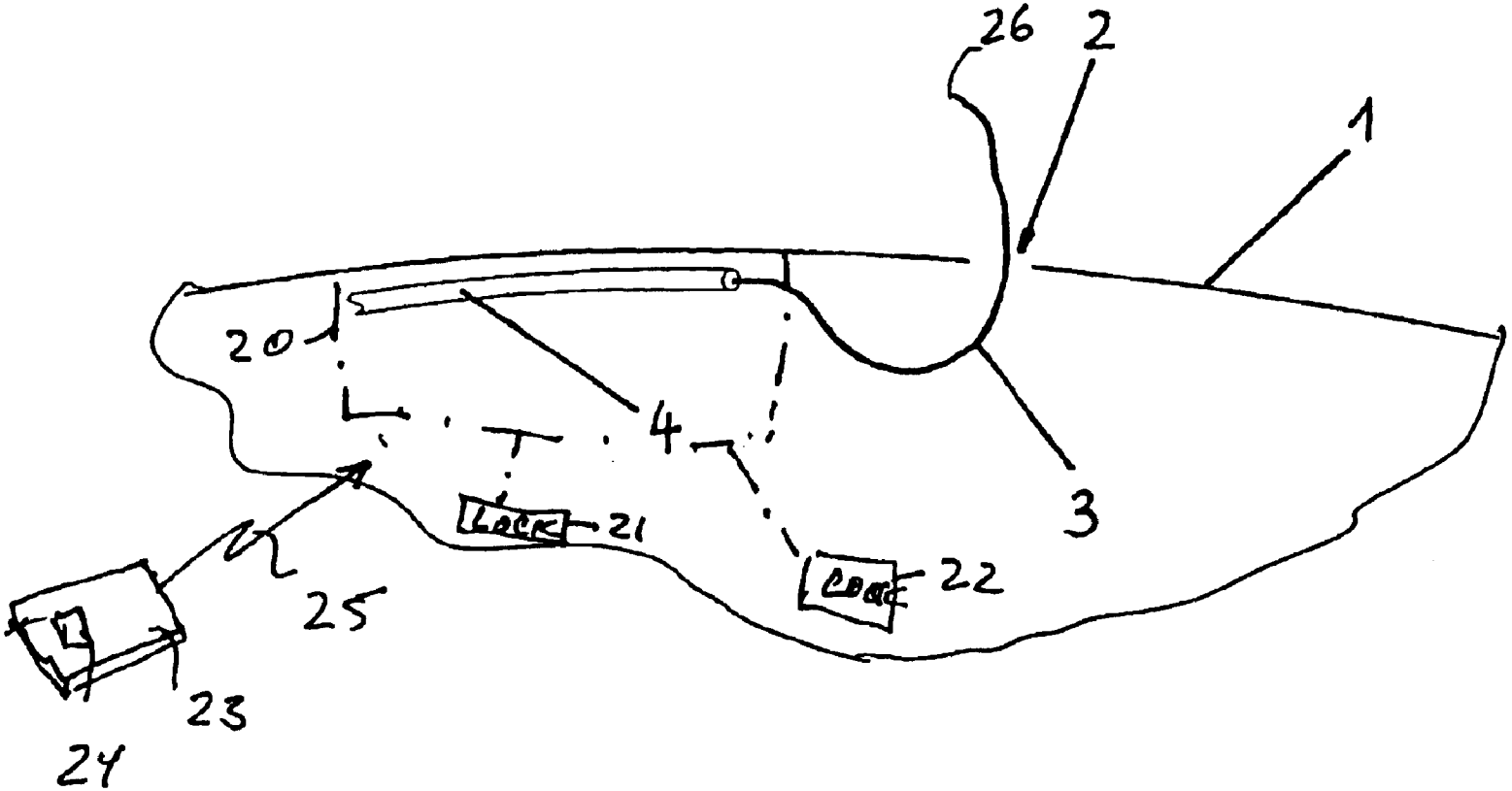
FIG. 1 is a diagram showing principles of the invention.

FIG. 1 shows a principle of the invention in which the roof 1 of a vehicle has been illustrated to represent the body of the vehicle and can be the portion of the vehicle over the passenger compartment. This roof 1 has an opening 2 through which a conductor 3 of a coaxial antenna cable 4 can extend to the exterior above the roof 1. The coaxial cable 4 can form the antenna for a keyless entry system represented diagrammatically at 20 and which includes the radiofrequency receiver for which the coaxial cable 4 is the antenna and which can be connected to the vehicle locks 21 and 22. To trigger the keyless entry system a transmitter 23 held in the hand of the vehicle operator and having a button 24 can transmit an unlocking signal 25 by radiofrequency to the antenna conductor 3. The free end 26 of this conductor lies at the exterior of the vehicle and thus is not shielded by the metal roof 1. The balance of the coaxial cable is insulated from the roof 1 and can lie within the vehicle forming part of the transmitter/receiver unit of the keyless entry system. The conductor 3 ensures that the signal for remote control of the keyless entry system will be received satisfactorily, independently of whether that signal derives from within the interior of the passenger compartment or from the exterior of the vehicle.

Figure 2:
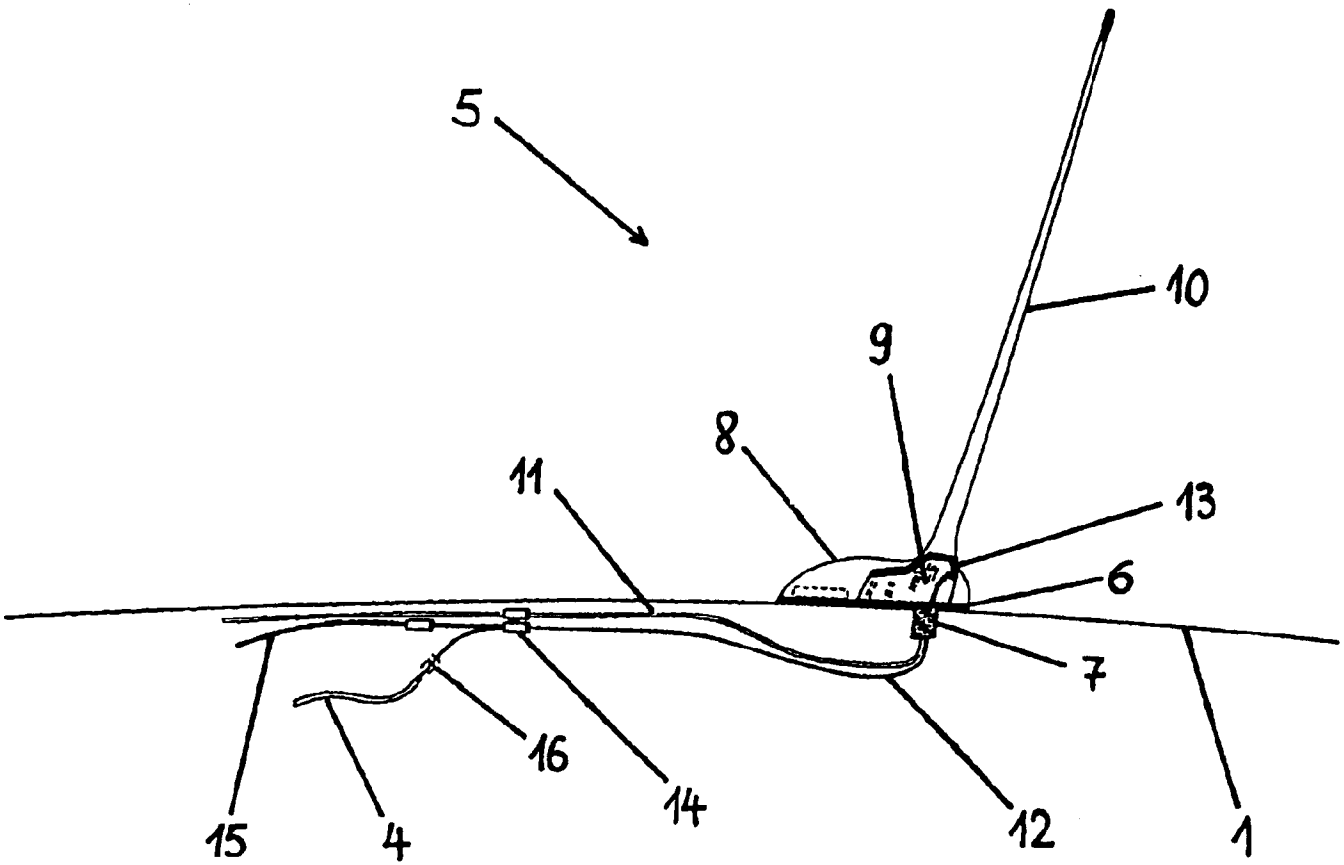
FIG. 2 is a cross sectional view through a part of the roof of a motor vehicle showing a roof antenna embodying the present invention.

FIG. 2 shows the application of the invention to a system in which the vehicle has a roof antenna 5 applied to the roof 1. The antenna 5 has a base 6 which is composed of metal and which is formed with a projection 7 extending through the opening through the roof 1. Above the base 6 the antenna housing 8 is composed of electrically insulating material such as a synthetic resin and this housing can include circuitry 9, 10 for the transmission or reception of signals for a multiplicity of radio transmission and reception purposes including, as described in DE 295 00 961, normal radio reception in the AM and FM bands, satellite navigation (GPS) and mobile radio services like for example AMPS, GSM, GSM 1800, UMTS and the like. The circuitry including that on the printed circuit board 9 and that represented at 10 or other circuitry is correspondingly configured. For the transmission of signals or the delivery of received signals, a feeder 11 is provided and in practice, two or more similar feeder lines 11 and 12, generally coaxial lines, can connect the antenna housing 8 with the internal circuitry within the vehicle. The feeders 11 and 12 serve to pass on the received signals and to deliver transmission signals for the antenna.

In the embodiment of FIG. 2 the feeder 12 is also formed as an antenna cable in the sense of the cable 4 described in connection with FIG. 1. In this embodiment, moreover, the feeder 12 not only serves for reception or transmission of signals for keyless entry for vehicle access but may also serve as the current supply for the circuitry of the antenna 5. The cable or signal pickup, however, may also be separate from the current supply cable.

One end of the feeder 12 can be a conductor 3 which has its free end connected to an electrically conducting surface 13 formed within the antenna housing 8 and thus unshielded by the roof 1. The opposite end of the feeder 12 can have a plug connection 14 at which the feeder 12 is divided to run to the coaxial cable 4 and to the current supply conductor 15. To couple received signals from the antenna cable 12, a coupling capacitor 16 can be provided and this capacitor can be integrated into the plug connector 14.

If the signals are delivered directly and there is no danger from supply current flow to the receiver, the coupling condenser 16 can be omitted. It is also conceivable that the lines 11, 12, 4 and 15 can be joined in a single cable strand.

We claim:

1. An automotive vehicle comprising:

a vehicle body;

a central locking system in said vehicle body and comprising a radiofrequency receiver and locks operated by said receiver;

an antenna connected to said receiver for receiving radiofrequency signals transmitted to said vehicle body and transmitting radiofrequency signals from said vehicle body, said body having an opening between an interior and an exterior thereof and said antenna having an antenna cable provided with a conductor extending through said opening and having a free end terminating at the exterior of said opening; and a device actuatable from the exterior of said body for producing a radiofrequency signal for pick up by said conductor.

2. The automotive vehicle defined in claim 1, further comprising an antenna structure on said vehicle body and capable of receiving and transmitting signals for a multiplicity of radio services, said antenna structure having at least one feeder to circuitry within said antenna structure, said conductor extending into said antenna structure.

3. The automotive vehicle defined in claim 2 wherein said antenna cable extends into an antenna housing forming part of said structure.

4. The automotive vehicle defined in claim 3 wherein said antenna structure is formed with an electrically conducting surface, said free end terminating at said surface.

5. The automotive vehicle defined in claim 3 wherein said antenna cable includes a plug for connection to a receiving and transmitting unit.

6. The automotive vehicle defined in claim 3 wherein said cable includes means for supplying electric current to circuitry of said antenna structure.

7. The automotive vehicle defined in claim 3, further comprising a capacitor for coupling signals from said conductor.

8. The automotive vehicle defined in claim 7 wherein said capacitor is incorporated in a plug connector for said cable.

* * * * *